US005908031A

United States Patent [19]

Clark et al.

[11] Patent Number: 5,908,031

[45] Date of Patent: Jun. 1, 1999

[54] INTERLOCKING REMOVABLE PIPE BASE

[76] Inventors: Raymond M. Clark, 6372 West Redfield, Glendale, Ariz. 85306; Gerald J. Hulsebus, 4532 West Softwind, Glendale, Ariz. 85310

[21] Appl. No.: 08/962,002

[22] Filed: Oct. 31, 1997

[51] Int. Cl.[6] ..... A24F 1/14; A24F 1/30

[52] U.S. Cl. ..... 131/173; 131/225; 220/293

[58] Field of Search ..... 131/173, 225; 215/232; 220/293, 297, 298, 300; D27/195

[56] References Cited

U.S. PATENT DOCUMENTS

| | | | |
|---|---|---|---|
| 3,881,499 | 5/1975 | McFadden et al. | 131/173 |
| 4,031,904 | 6/1977 | Karl | 131/173 |
| 5,400,807 | 3/1995 | Newman . | |
| 5,489,043 | 2/1996 | Newman | 220/737 |

*Primary Examiner*—James Derrington
*Assistant Examiner*—Kevin Cronin

[57] ABSTRACT

A tobacco water pipe for smoking loose leaf tobacco, the tobacco water pipe having a base and an elongated tube, the elongated tube being removably interlocked to the base of the tobacco water pipe. To removably interlock the base and the elongated tube, the base of the water pipe has a seat member which is at least partially embedded into the base of the tobacco water pipe and the elongated tube has a sleeve member which is affixed to the lower most portion of the elongated tube. The seat member of the base is configured to receive the sleeve member of the elongated tube. The sleeve member alone, or in connection with a collar member, is designed to interlock with the seat member, securely fastening the elongated tube to the base of the tobacco water pipe.

17 Claims, 4 Drawing Sheets

12
10
30
18
36
14

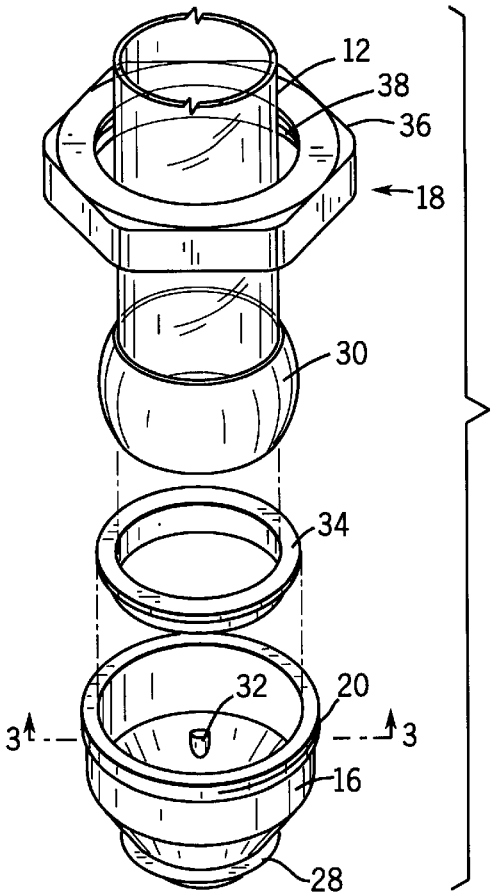
FIG. 2
FIG. 3
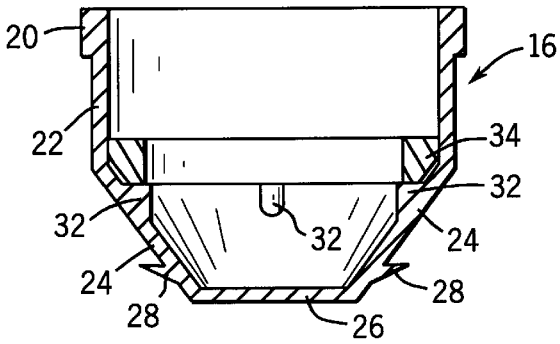
FIG. 4
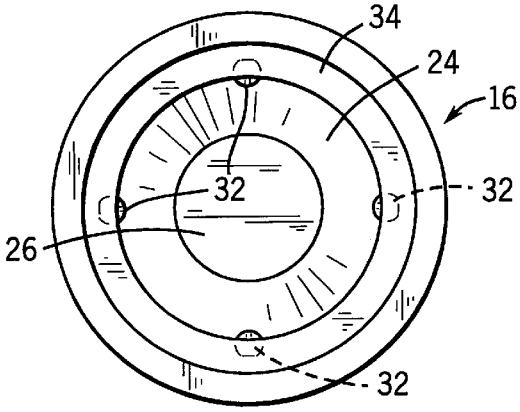

FIG. 7
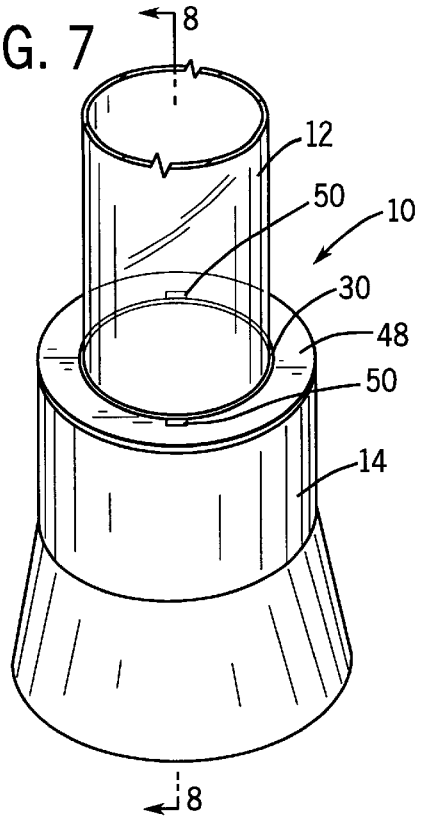
FIG. 8
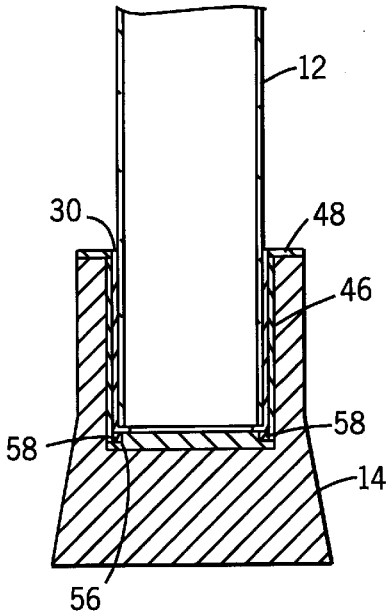
FIG. 9
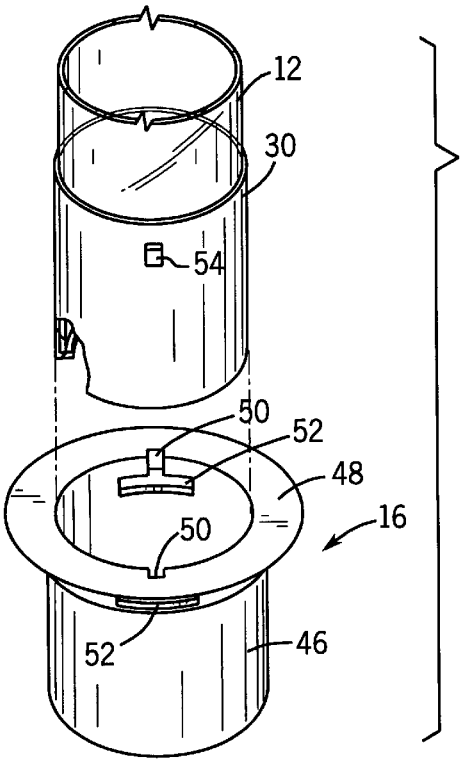
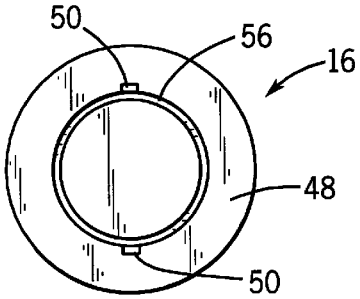
FIG. 10

INTERLOCKING REMOVABLE PIPE BASE

BACKGROUND OF INVENTION

The present invention relates to a tobacco water pipe for loose tobacco, and more particularly, to a tobacco water pipe having an elongated tube which is easily removable from the base of the tobacco water pipe.

Tobacco water pipes have long been used to remove the nicotine and tar in tobacco smoke and to cool the tobacco smoke. By incorporating a water bath into the smoking pipes, the pipes are then able to filter and cool the smoke which makes smoking more enjoyable.

One problem with tobacco water pipes is that the construction of the water pipes makes it difficult to clean the water bath area between uses. Most often, the elongated tube of the tobacco water pipe is permanently affixed to the base of the tobacco water pipe making it difficult to reach the interior of the pipe which contained the water bath. Because the water bath acts to filter the smoke, the water bath becomes quickly saturated with tar deposits and other smoke particles. Thus, the water must be frequently removed from the tobacco water pipe and the pipe must be cleaned in order to prevent the build-up of tar and smoking particles in the interior of the pipe.

Another problem with the traditional tobacco water pipes is that the elongated tubes are made of acrylic or glass and are therefore easily broken. As previously mentioned, the elongated tubes are most always permanently affixed to the base of the tobacco water pipe. Thus, when an elongated tube is broken, the pipe is rendered virtually useless. Today, many tobacco water pipes come with decorative ceramic bases and this can make the replacement of an entire pipe rather expensive.

SUMMARY OF INVENTION

Accordingly, it is the object of the present invention to provide a tobacco water pipe having a removable elongated tube. Having a removable elongated tube makes cleaning of the water pipe easier. Yet another object of the present invention is to provide a base having a standard sized seat member embedded into the base which allows the elongated tubes to be interchangeable among different bases. Similarly, this interchangeability between the bases and elongated tubes allows broken elongated tubes and broken bases to be more easily replaced.

Still another object of the present invention is to provide a removable elongated tube which rotates and or pivots relative to the base of the tobacco water pipe. This allows the elongated tube of the pipe to be secured against the base at a variety of different angles. Yet another object is to provide a base having a seat member which can engage a variety of other articles in addition to an elongated tube.

In accordance with these objects, the present invention comprises a tobacco water pipe having a base and an elongated tube, the elongated tube being removably interlocked to the base of the tobacco water pipe. To removably interlock the base and the elongated tube, the base of the water pipe has a seat member which is at least partially embedded into the base of the tobacco water pipe and the elongated tube has a sleeve member which is affixed to the lower most portion of the elongated tube. The seat member of the base is configured to receive the sleeve member of the elongated tube. The sleeve member alone, or in connection with a collar member, is designed to interlock with the seat member, securely fastening the elongated tube to the base of the tobacco water pipe.

BRIEF DESCRIPTION OF THE DRAWINGS

FIG. 2 is an exploded front perspective view of the first embodiment of the present invention, showing the elongated tube having a rounded sleeve attached thereto, the collar member, the pivot ring and the threaded seat member.

FIG. 3 is a cross-sectional view of the threaded seat member taken along line 3—3 of FIG. 2.

FIG. 4 is a plan view of the seat member and the pivot ring.

FIG. 7 is a front perspective view of a third embodiment of the present invention.

FIG. 8 is a cross-sectional view of the third embodiment taken along line 8—8 of FIG. 7.

FIG. 9 is an exploded view of the elongated tube of the third alternative embodiment removed from the base member.

FIG. 10 is a plan view of the third embodiment of the present invention.

DESCRIPTION OF PREFERRED EMBODIMENT

Figure 1:
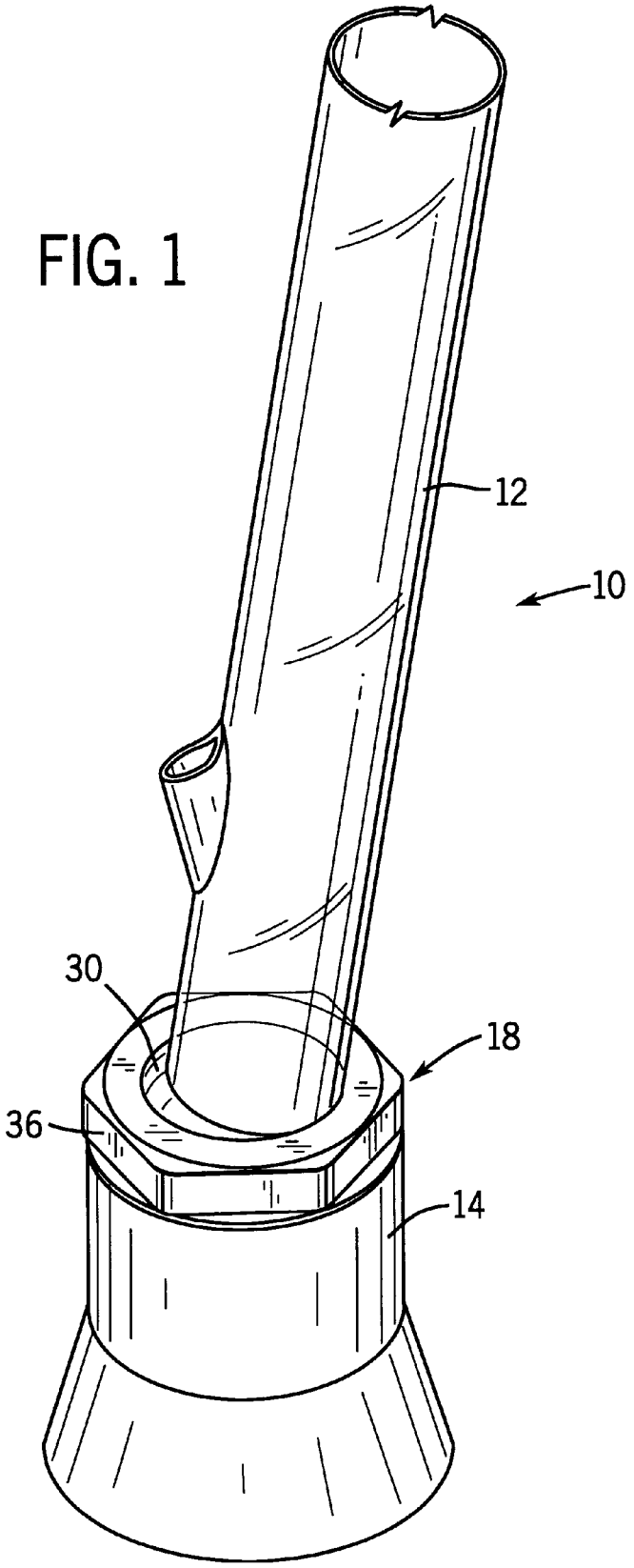
FIG. 1 is a front perspective view of a first embodiment of the present invention.

As illustrated by FIGS. 1–10, the present invention is directed toward a tobacco water pipe 10 having an elongated tube 12 and a base 14. The elongated tube 12 has a means for being interlocked to the base 14 of the tobacco water pipe 10 so that the elongated tube 12 can be easily removed from the base 14 of the tobacco water pipe 10. The means for interlocking the elongated tube 12 to the base 14 of the tobacco water pipe 10 generally consists of (1) a seat member 16 which is at least partially embedded into the base 14 of the tobacco water pipe 10 and (2) a securing means 18 which is associated with the elongated tube 12. The securing means 18 is designed to communicate with the seat member 16 to interlock the elongated tube member 12 to the base 14.

FIGS. 1–4 illustrate the first embodiment of the present invention. In this embodiment, the seat member 16 is a cup-shaped structure having a threaded peripheral rim 20, a radially throat portion 22, a conically tapered portion 24, and a planar base member 26. The throat portion 22, conically tapered portion 24 and planar base member 26 each have inner and outer surfaces. Additionally, the seat member 16 has a peripheral flanged edge 28 which extends around the outer surface of the conically tapered portion 24 of the seat member 16. This peripheral flanged edge 28 helps to secure the seat member 16 to the base 14 of the tobacco water pipe 10.

As previously discussed, the threaded seat member 16 is partially embedded into the base 14 of the tobacco water pipe 10. The base 14 is manufactured with a depressed recess on the exterior of the base 14 for receiving at least a portion of the threaded seat member 16. The threaded seat member 16 is then secured into the depressed recess of the base 14 by epoxy or other like substance. In this embodiment, all of the exterior surfaces of the seat member 16 are set into the base 14 except the threaded peripheral rim 20 which must be raised above the surface of the base 14 to provide a mechanism for securing the elongated tube 12 to the base 14 of the tobacco water pipe 10. Additionally, the threaded peripheral rim 20 may be countersunk into the recess of the base 14 where the diameter of the recess is sufficient to accommodate the securing means 18. While FIG. 1 shows the seat member 16 secured in an upright position at the top of the base 14, the seat member 16 can be positioned in a recess located most anywhere on the base 14 of the tobacco water pipe 10. Thus, the positioning of the seat member 16 can be dictated by the base 14 design.

As seen in FIG. 2, the elongated tube 12 has a rounded sleeve member 30 which is positioned on the lower portion of the elongated tube 12. In this embodiment, the rounded sleeve member 30 is closed at one end to prevent fluid exchange between the base and the elongated tube. It is, however, recognized that the sleeve member 30 may be open-ended or closed-ended. (See FIG. 9, demonstrating the use of an open-ended sleeve member). The interior circumference of the rounded sleeve member 30 is such that rounded sleeve member 30 tightly grips the lower exterior portion of the elongated tube 12. The sleeve member 30 can then be secured against the exterior of the elongated tube 12 by an epoxy or like substance.

Similarly, the largest exterior circumference of the rounded sleeve member 30 is sized to fit within the throat portion 22 of the seat member 16. As seen in FIGS. 2–4, the interior surface of the conically tapered portion 24 of the seat member 16 has four support members 32 which function to support a pivot ring 4. As illustrated by FIGS. 3 and 4, the outer diameter of the pivot ring 34 is sized to the interior diameter of the throat portion 22. The pivot ring 34 is then placed within the throat portion 22 of the seat member 16 and then rests against the support members 32. The interior circumference of the pivot ring 34 is sized to support the rounded sleeve member 30 without inhibiting the rounded sleeve member's 30 ability to pivot or move about the base 14 of the tobacco water pipe 10. In use, the rounded sleeve member 30 of the elongated tube 12 sits against the interior circumference of the pivot ring 34. Because the exterior of the rounded sleeve member 30 is generally of spherical circumferential profile, the sleeve member 30 then pivots on the interior circumference of the pivot ring 34.

In this embodiment, the securing means 18 comprises a collar member 36 having interior threading 38 which corresponds to the threaded peripheral rim 20 of the seat member 16. As illustrated in FIGS. 1 and 2, this collar member 36 slides about the exterior circumference of the elongated tube 12. Once the elongated tube 12 is positioned at a desirable angle in the interior of the seat member 16, the interior threading 38 of the collar member 36 can coupled with threaded peripheral rim 20 of the seat member 16, thereby restraining the motion of the elongated tube 12 and holding the elongated tube 12 tightly against the seat member 16.

Figure 5:
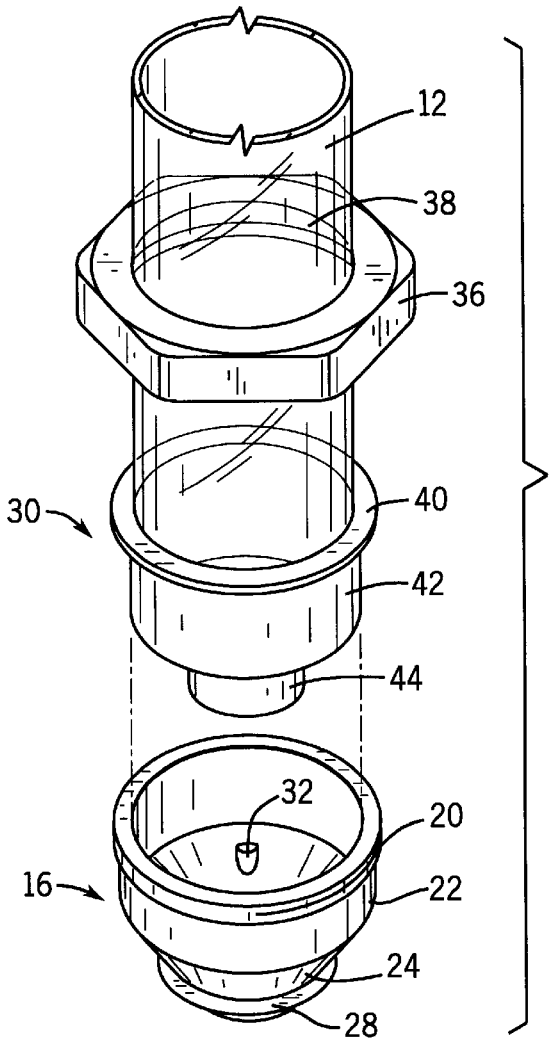
FIG. 5 is an exploded front perspective view of a second alternative embodiment of the present invention, showing the cylindrical sleeve member attached to the tube member, the collar member and the threaded seat member.
Figure 6:
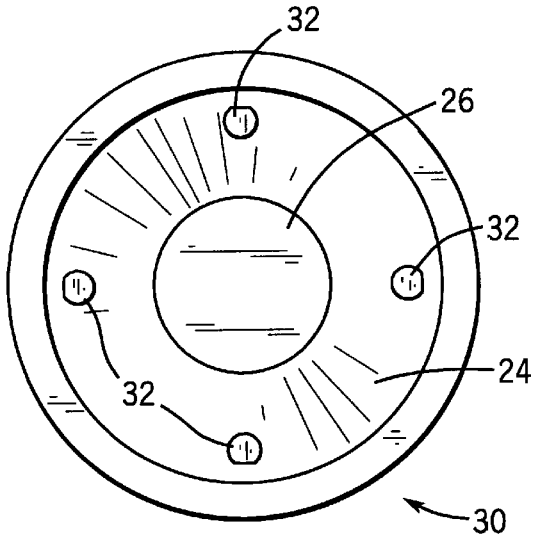
FIG. 6 is a plan view of seat member absent the pivot ring.

FIGS. 5 and 6 illustrate a second alternative embodiment of the present invention. This embodiment is similar to the first embodiment except that the sleeve member 30 is not a rounded sleeve member 30 and does not allow the elongated tube 12 to pivot about the base 14 of the tobacco water pipe 10. As seen in FIG. 5 the sleeve member 30 is a cup shaped member, similar in shape to the seat member 16. As seen in FIG. 5, the sleeve member 30 fits on the lower portion of the elongated tube 12. The sleeve member 30 is comprised of a peripheral rim 40, a cylindrical body portion 42 and cylindrical support member 44.

As best seen in FIG. 5, this sleeve member 30 is contoured to fit inside the seat member 16 such that the peripheral rim 40 of the sleeve member 30 is positioned over the threaded peripheral rim 20 of the seat member 16, the cylindrical body portion 42 fits into the throat portion 22 of the seat member 16, and the cylindrical support member 44 extends downward through the conically tapered portion 24 of the seat member 16 and rests upon the planar base member 26. Like the first embodiment, the sleeve member 30 is a closed-ended member which prevents fluid flow between the interior of the elongated tube 12 and the base 14.

Also, like the first embodiment, the securing means 18 is a collar member 36 having an interior threading 38 which is coupled with the threaded peripheral rim 20 of the seat member 16. The peripheral rim 40 of the sleeve member 30 is compressed between the collar member 36 and the seat member 16 when the collar member 36 is brought into engagement with seat member 16, thereby assisting in the securing of the tobacco water pipe 10 in an upright position. Because the elongated tube 12 does not pivot about the seat member 16, the pivot ring 34 is not used in this embodiment. The base of the cylindrical body portion 42 of the sleeve member 30 rests directly upon the four support members 32 of the seat member 16.

FIGS. 7–10 illustrate a third alternative embodiment of the present invention. In this embodiment, the seat member 16 is a cylindrical metal piece 46 having an open end for receiving the sleeve member 30 of the elongated tube 14, a closed-end, and a rim portion 48 which extends outward from the open end of the seat member 16.

As shown in FIG. 9, the sleeve member 30 is a cylindrical sleeve having an inner diameter slightly larger than that of the exterior diameter of the elongated tube 12. This allows the sleeve member 30 to fit tightly over the lower portion of the elongated tube 12. As in the first and second embodiments, this sleeve member 30 can then be secured against the elongated tube 12 with epoxy or other like substance. Similarly, the cylindrical sleeve 30 has an outer diameter which is slightly smaller than the interior diameter of the seat member 16 so that the cylindrical sleeve 30 fits inside the cylindrical seat member 16 of the base 14.

Unlike the first and second embodiments, the third embodiment does not utilize a collar 36 to secure the elongated tube 12 against the base 14. Rather, this embodiment uses a slot 50 and groove 52 type mechanism which interlocks the cylindrical sleeve member 30 to the cylindrical seat member 16. As illustrated in FIG. 9, the sleeve member 30 has two opposing pins 54 which extend outward from the exterior surface of the sleeve member 30. These two pins 54 then correspond to slots 50 found along the interior sides of the seat member 16. The pins 54 also correspond in length and width to the slots 50 and grooves 52 of the seat member 16. Once the pins 54 are positioned completely into the slots 50 of the seat member 16, the pins are then also within the grooves 52 of the seat member. As seen in FIG. 9, these grooves 52 which run perpendicular to the slots 50 of the seat member 16. Once the pins 54 are in the grooves 52, the sleeve member 30 can be rotated counter-clockwise or clockwise in relation to the seat member 16 such that the pins 54 are moved through the grooves 52 in the seat member 30 and away from the slots 50, thereby interlocking the cylindrical sleeve member 30 to the cylindrical seat member 16.

To form a fluid tight seal between the sleeve member 30 and seat member 16, a circular recess 56 is located in the interior of the closed-end of the seat member 30. This is best illustrated by FIGS. 8 and 10. This circular recess 56 is positioned directly under, and corresponds with, the lower peripheral edge of the sleeve member 30 when the sleeve member 30 is seated in the seat member 16. To form the fluid tight seal, a rubber O-ring 58 is placed within the circular recess 56 of the seat member 16 such that the O-ring 58 forms a seal between the bottom peripheral edge of the sleeve member 30 and closed-end of the seat member 16 when the sleeve member 30 is interlocked with the seat member 16.

Although the foregoing detailed description of the present invention has been described by reference to three alternative embodiments, and the best mode contemplated for carrying out the present invention has been herein shown and described, it will be understood that modifications or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

We claim:

1. A pipe for smoking tobacco, said pipe comprising:

(a) a base;

(b) a seat member having an open interior chamber and an upper peripheral surface, the open interior chamber of said seat member having lateral side walls, the lateral side walls of said seat member having at least one slot formed therein which communicates with and opens to the upper peripheral surface of said seat member, said seat member at least partially embedded into said base; and (c) an elongated tube having upper and lower portions, said elongated tube having a sleeve member affixed to the lower portion of said elongated tube, said sleeve member being sized to fit within the lateral side walls of said seat member, said sleeve member having at least one outwardly projecting pin which communicates with said slot when said sleeve member is positioned within said seat member.

2. The pipe as recited in claim 1, wherein the seat member comprises a metal material.

3. The pipe as recited in claim 1, wherein the at least one slot comprises a pair of slots and the at least one outwardly projecting pin comprises a pair of outwardly projecting pins.

4. A pipe for smoking tobacco, comprising:

a base;

an elongated tube;

an interlocking mechanism that cooperates with the base and the elongated tube, wherein the interlocking mechanism mav be used selectively to lock the elongated tube to the base and to release the elongated tube from the base, the interlocking mechanism comprising a seat member connected to the base and a sleeve member connected to the elongated tube, wherein the seat member includes an open chamber sized to slidably receive the sleeve member.

5. The pipe as recited in claim 4, wherein the seat member includes at least one slot formed therein and the sleeve member includes at least one outwardly projecting pin positioned to engage the at least one slot and hold the sleeve member in the open chamber.

6. The pipe as recited in claim 4, further comprising a seal disposed between the seat member and the sleeve member to create a fluid-tight seal therebetween when the sleeve member is properly inserted into the open chamber.

7. A pipe for smoking tobacco, comprising:

a base;

an elongated tube;

an interlocking mechanism that cooperates with the base and the elongated tube, wherein the interlocking mechanism may be used selectively to lock the elongated tube to the base and to release the elongated tube from the base, the interlocking mechanism comprising a seat member connected to the base and a sleeve member connected to the elongated tube, wherein the sleeve member includes a rounded outer surface and the seat member includes an open chamber sized to receive the sleeve member such that the sleeve member and elongated tube may be pivoted to a plurality of positions.

8. The pipe as recited in claim 7, further comprising a pivot ring disposed generally between the rounded outer surface of the sleeve member and the open chamber of the seat member, wherein the pivot ring facilitates pivoting of the sleeve member and the elongated tube with respect to the seat member.

9. The pipe as recited in claim 8, further comprising a collar member to secure the sleeve member and the elongated tube to the seat member at a desired angle with respect to the seat member.

10. A pipe for smoking tobacco, comprising:

a base;

a seat member at least partially embedded in the base, the seat member including an open chamber;

an elongated tube having an upper portion and a lower portion;

a sleeve member attached to the lower portion and sized to be received in the open chamber; and an interlocking portion configured to permit selective engagement and disengagement of the sleeve member with the seat member.

11. The pipe as recited in claim 10, wherein the seat member and the sleeve member comprise a metal material.

12. The pipe as recited in claim 10, wherein the seat member includes at least one slot formed therein and the sleeve member includes at least one outwardly projecting pin positioned to engage the at least one slot and hold the sleeve member in the open chamber.

13. The pipe as recited in claim 12, wherein the at least one slot comprises a pair of slots and the at least one outwardly projecting pin comprises a pair of outwardly projecting pins.

14. The pipe as recited in claim 10, wherein the open chamber is circular in cross-section.

15. The pipe as recited in claim 10, wherein the sleeve member includes a rounded outer surface and the seat member includes an open chamber sized to receive the sleeve member such that the sleeve member and elongated tube may be pivoted to a plurality of positions.

16. The pipe as recited in claim 15, further comprising a pivot ring disposed generally between the rounded outer surface of the sleeve member and the open chamber of the seat member, wherein the pivot ring facilitates pivoting of the sleeve member and the elongated tube with respect to the seat member.

17. The pipe as recited in claim 15, wherein the interlocking portion comprises a collar member to secure the sleeve member to the seat member, further wherein the sleeve member is closed to prevent any fluid transfer therethrough.

* * * * *